United States Patent [19]

Bergman et al.

[11] Patent Number: 4,765,166

[45] Date of Patent: Aug. 23, 1988

[54] CAVITY FORMING PRESS

[75] Inventors: Carl Bergman; Lennart Svensson, both of Västerås, Sweden

[73] Assignee: ASEA Aktiebolag, Västeras, Sweden

[21] Appl. No.: 62,386

[22] Filed: Jun. 15, 1987

Related U.S. Application Data

[63] Continuation of Ser. No. 817,281, Jan. 9, 1986, abandoned.

[30] Foreign Application Priority Data

Jan. 11, 1985 [SE] Sweden ..... 8500124

[51] Int. Cl.[4] ..... B21D 22/10

[52] U.S. Cl. ..... 72/63; 72/57; 72/60; 29/421.1; 425/389; 425/DIG. 19

[58] Field of Search ..... 72/54, 56, 63, 709, 72/60, 57; 29/421 R; 425/389, DIG. 14, DIG. 112,394, 405 R

[56] References Cited

U.S. PATENT DOCUMENTS

| | | | |
|---|---|---|---|
| 669,279 | 3/1901 | Harrington | 72/63 |
| 2,298,223 | 10/1942 | Miller | 425/DIG. 112 |
| 2,348,921 | 5/1944 | Davlecka | 72/63 |
| 3,167,043 | 1/1965 | Furth | 72/60 |
| 3,177,689 | 4/1965 | Christian et al. | 72/56 |
| 3,463,035 | 8/1969 | Bright | 72/56 |
| 3,545,241 | 12/1970 | Grankonski et al. | 72/63 |

FOREIGN PATENT DOCUMENTS

| | | | |
|---|---|---|---|
| 582032 | 11/1977 | U.S.S.R. | 72/60 |

OTHER PUBLICATIONS

"The Quintus Sheet Metal Forming Programme", pamphlet AQ-103E (edition 2) published 1983 by Aseq AB.

*Primary Examiner*—David Jones

*Attorney, Agent, or Firm*—Watson, Cole, Grindle & Watson

[57] ABSTRACT

A press for shaping a sheet metal blank in a cavity with a forming tool which determines the shape of the finished product. The sheet is pressed against the tool by a diaphragm which is influenced by a pressure medium on the side facing away from the cavity. The forming tool consists of an inexpensive casting material supported in a cup-shaped container. The space between the bottom and sides of the container and the bottom and sides of the cavity is filled with an elastic material.

9 Claims, 3 Drawing Sheets

CAVITY FORMING PRESS

This application is a continuation of application Ser. No. 817,281 filed Jan. 9, 1986, now abandoned.

TECHNICAL FIELD

The present invention relates to a press for shaping a sheet blank by means of a liquid pressure medium which, via a diaphragm and a forming pad is pressed against the blank, and a tool which determines the shape of the final product. The tool is placed in a cavity below the diaphragm and the forming pad. During pressing the cavity is completely closed. This forming method is commonly called "fluid forming".

PRIOR ART

Fluid forming is used to a large extent for forming sheet metal parts in the aircraft industry. Presses for this purpose include a press stand and a cavity or space in which a tool and a blank are placed. A diaphragm acts directly, but usually via a forming pad, against the blank with a very large press force (up to 20,000 tons or even more) when pressure medium is pumped into a space on that side of the diaphragm facing away from the cavity. In one known press of the above-described type, the cavity is formed by a ring which rests on the press table of a press stand. A fixed piston is suspended from the press stand. The piston is surrounded by a movable cylinder, at the lower end of which a diaphragm is attached, which diaphragm can also constitute a forming pad or a diaphragm and a separate forming pad. Between the diaphragm and the piston there is a further cavity for a pressure medium, which acts against the diaphragm during the pressing operation. The cylinder is raisable and lowerable between an upper or open position, where the cavity is accessible for removal of a pressed part, and a lower or closed position, where the cavity is closed. A press of the kind mentioned above and the above-mentioned forming method are described in Pamphlet AQ 30-103E (Edition 2) published in 1983 by ASEA AB of Västerås, Sweden.

SUMMARY OF THE INVENTION

According to the invention, the press includes a cup-shaped container in which the tool is placed. A space between the container and the sides and bottom of the cavity is filled with a material in which a pressure propagates in all directions. This filling material may consist of a fluid or an elastic material such as rubber or plastics material with such a hardness that compressive forces are propagated within the material, approximately as in a fluid. The tool usually consists of a cast compound cast directly in the cup-shaped container.

The known presses can develop cracks in the tool during pressing due to the expansion of a force absorbing ring surrounding the cavity. One object of the invention is to reduce the possibility of such cracks forming.

BRIEF DESCRIPTION OF THE DRAWINGS

The invention will now be further described, by way of example, with reference to the accompanying drawings which show a press at three different stages.

DESCRIPTION OF PREFERRED EMBODIMENT

Figure 1:
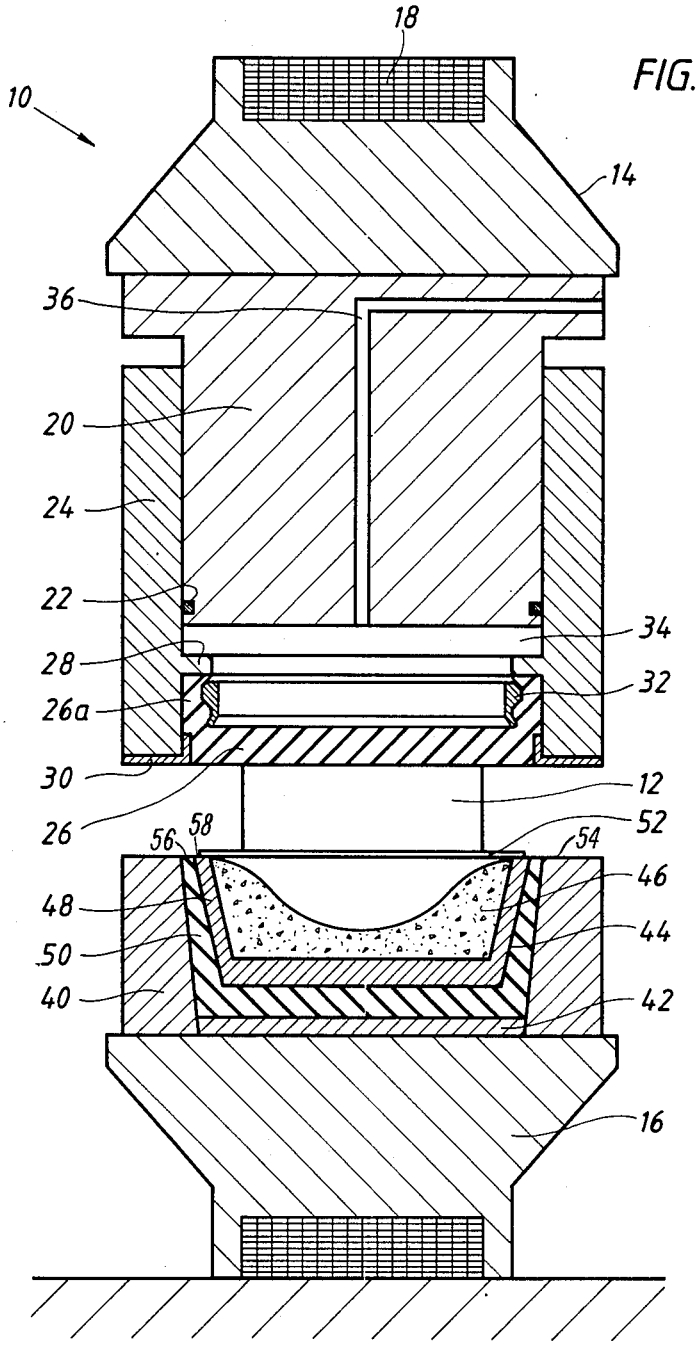
FIG. 1 shows a press open for removal of a pressed sheet metal part and insertion of a new blank.

In the FIGS., 10 designates a press stand of the type consisting of two columns 12 (only one of which is shown), an upper yoke 14 and a lower yoke 16 and a force-absorbing sheet-winding 18 surrounding the yokes and columns. The yokes 14 and 16 respectively define an upper and a lower press table. A piston 20 is attached to the underside of the upper yoke 14 and an annular cylinder 24 surrounds the piston. Mounted within the cylinder 24, at its lower end, is a diaphragm 26 which is located below a flange 28 formed in the cylinder. The diaphragm 26 is held in place by a lower flange 30, which is attached to the cylinder 24 by bolts (not shown). The diaphragm 26 has a substantial thickness and acts as a forming pad during use of the press. An upwardly projecting flange **26*a* of the diaphragm 26 is held pressed against the inner wall of the cylinder 24 by a clamping ring 32. Between the diaphragm 26 and the piston 20, a closed space 34 is formed which communicates with pressure-generating equipment (not shown) via a channel 36 provided in the piston 20. A sealing ring 22 closes the space 34 from any annular gap between the piston 20 and the cylinder 24**.

Figure 2:
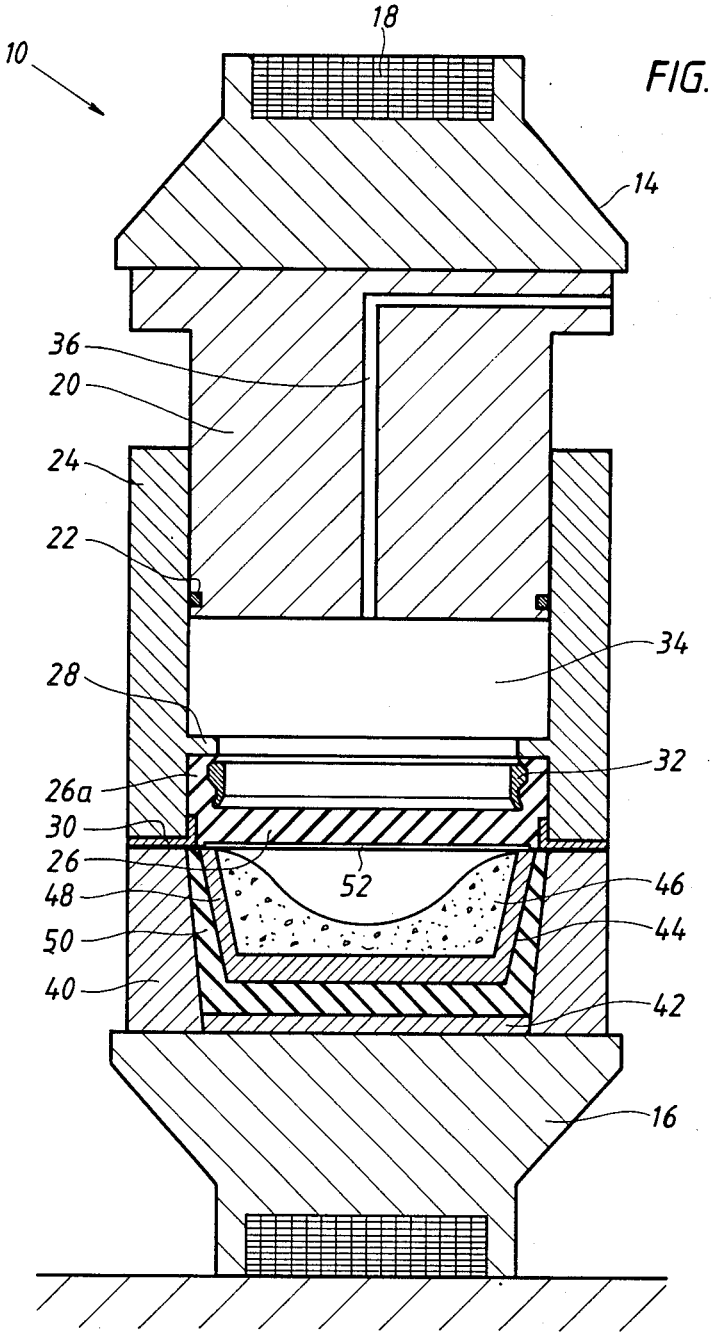
FIG. 2 shows the press closed immediately prior to pressing.
Figure 3:
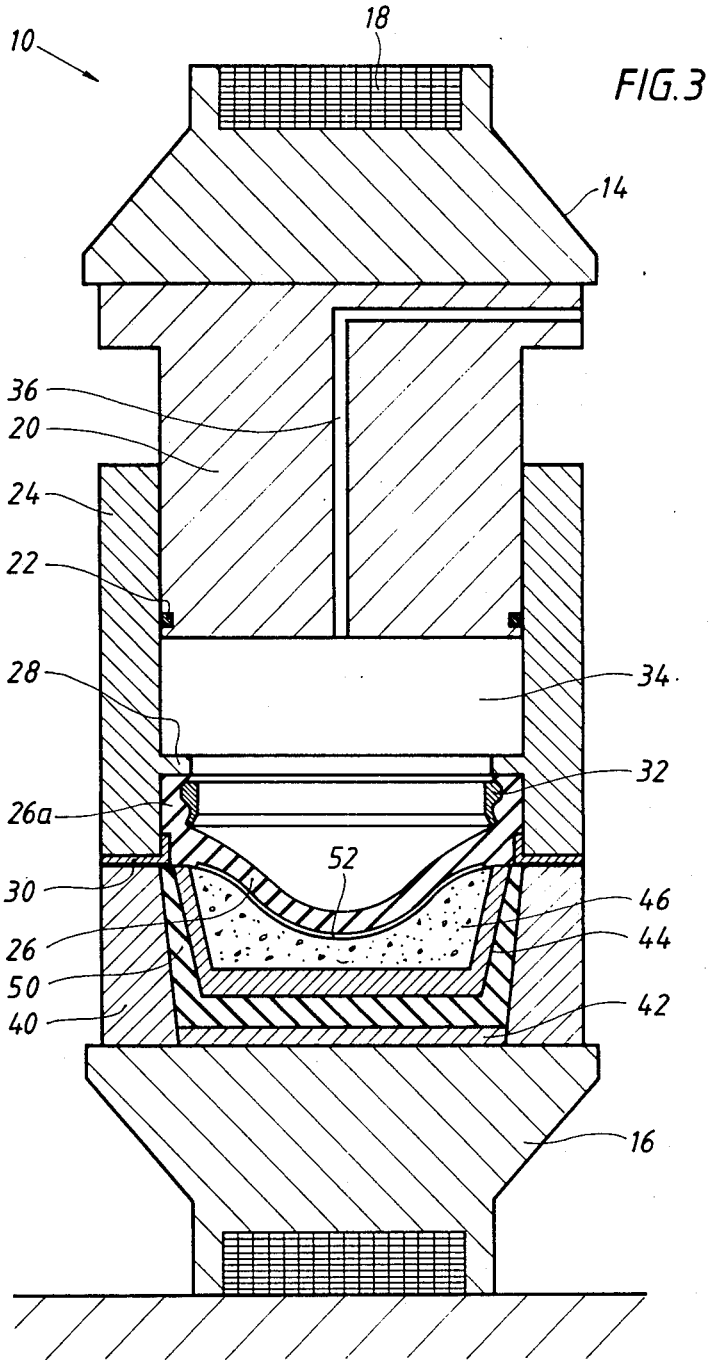
FIG. 3 shows the press closed at the end of the actual pressing operation.

The cylinder 24 is movable between an upper position, shown in FIG. 1, and a lower position, shown in FIGS. 2 and 3, by operating cylinders (not shown).

On the lower yoke 16, a ring 40 with a removable bottom plate 42 is provided. When the cylinder 24 is in its lower position, as shown in FIGS. 2 and 3, flange 30 engages end wall 54 of ring 40, and a closed cavity 44 is formed between the bottom plate 42 and the diaphragm 26. In the cavity 44 a forming tool 46 is located in a cup-shaped container 48. The space between the container or tool carrier 48, the bottom plate 42 and the inner surface of the ring 40 is filled up with an elastic material 50. FIGS. 1 and 2 show a plane sheet billet 52 placed on top of the container 48 and its contained forming tool 46. FIG. 3 shows the sheet billet 52 shaped into a product at the end of the pressing operation.

And, it is to be noted that end walls 56 and 58 of elastic material 50 and of tool carrier 48 are coplanar with end wall 54 of ring 40. Thus, when the elastomeric medium 50 is loaded, as described hereinafter, a pressure propagates in all directions entirely about the tool carrier without the need to strengthen the upper end of the mold to take up radial forces, as in some of the known molds.

During the pressing operation, the ring 40 will be exposed to a large radially outwardly directed force, which means that the ring is deformed somewhat so that its diameter increases. It has been found that a cast forming tool of a shape shown in the drawings and made of an inexpensive pressure-resistant material, for example a plastic material, which has been cast directly in the ring 40, will crack during the radial expansion of the ring 40 due to the tensile forces occurring. By casting the forming tool 46 in a cup-shaped container 48 of steel and filling the cup-shaped space between the bottom plate 42 and the ring 40 with an elastic material 50 (for example having a hardness less than 50° Shore), tensile stresses and the consequent formation of cracks can be eliminated. During pressing the elastic material 50 will, to a greater or less extent, depending on the hardness of the material, behave as a fluid, so that the pressure is propagated in all directions. This means that the frusto-conical side wall of the container 48 will be subjected to approximately equally large forces from both sides. In this way, the deformation and hence the stresses in the forming tool 46 will be insignificant. The risk of cracks forming is thus eliminated.

The illustrated embodiment may be varied in many ways within the scope of the following claims. For example, instead of the diaphragm 26 being a one piece component as shown, a thin-walled sealing diaphragm and a separate forming pad of a different material may be used.

We claim:

1. A press stand for shaping a sheet blank by pressing it against a forming tool, said press stand comprising a first press table which provides a support surface, a rigid ring located on said support surface, said rigid ring having an inner surface and a flat end surface remote from said first press table, said flat end surface defining an imaginary plane, a bottom plate located within said rigid ring and resting on said support surface of said first press table, a cup-shaped container located within said rigid ring in spaced fashion from both the inner surface of said rigid ring and from said bottom plate, said cup-shaped container containing said forming tool and having a flat end surface remote from said first press table, an elastic material filling the space between said cup-shaped container and both the inner surface of said cylindrical ring and said bottom plate, said elastic material providing a flat end surface remote from said first press table and located in said imaginary plane, an annular cylinder which is movable towards and away from said first press table, said annular cylinder including a flange which is abuttable against the flat end surface of said cylindrical ring, said flange supporting a flexible diaphragm, and piston means within said annular cylinder which, together with said flexible diaphragm and said annular cylinder provides a closed space, said piston means including a channel for the supply of pressure medium to said closed space for moving said flexible diaphragm against a sheet blank positioned on the end surface of said cup-shaped container and causing said sheet blank to bend against the forming tool within said cup-shaped container, said elastic material propagating the pressure applied thereagainst by said cup-shaped container in all directions.

2. A press stand according to claim 1, wherein the flat end surface of said cup-shaped container which is remote from said first press table is located in said imaginary plane.

3. A press stand according to claim 1, wherein said elastic material consists of a rubber elastic material.

4. A press stand according to claim 1, wherein said elastic material consists of a plastic material.

5. A press stand according to claim 3, wherein said rubber elastic material has a hardness of less than 50° Shore.

6. A press stand according to claim 1, wherein said forming tool consists of a cast compound cast directly into the cup-shaped container.

7. A press stand according to claim 3, wherein said forming tool consists of a cast compound cast directly into the cup-shaped container.

8. A press stand according to claim 1, wherein said forming tool consists of a cast compound of a plastic-like material applied directly into the cup-shaped container.

9. A press stand according to claim 3, wherein said forming tool consists of a cast compound of a plastic-like material applied directly into the cup-shaped container.

* * * * *